US008075338B1

(12) United States Patent
Montena

(10) Patent No.: US 8,075,338 B1
(45) Date of Patent: Dec. 13, 2011

(54) CONNECTOR HAVING A CONSTANT CONTACT POST

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/906,503

(22) Filed: Oct. 18, 2010

(51) Int. Cl.
*H01R 9/05* (2006.01)

(52) U.S. Cl. ..... 439/578

(58) Field of Classification Search ..... 439/578–585
See application file for complete search history.

(56) References Cited

U.S. PATENT DOCUMENTS

| | | | |
|---|---|---|---|
| 1,667,485 | A | 4/1928 | MacDonald |
| 1,766,869 | A | 6/1930 | Austin |
| 2,258,737 | A | 10/1941 | Browne |
| 2,325,549 | A | 7/1943 | Ryzowitz |
| 2,480,963 | A | 9/1949 | Quinn |
| 2,544,654 | A | 3/1951 | Brown |
| 2,549,647 | A | 4/1951 | Turenne |
| 2,694,187 | A | 11/1954 | Nash |
| 2,754,487 | A | 7/1956 | Carr et al. |
| 2,755,331 | A | 7/1956 | Melcher |
| 2,757,351 | A | 7/1956 | Klostermann |
| 2,762,025 | A | 9/1956 | Melcher |
| 2,805,399 | A | 9/1957 | Leeper |
| 2,870,420 | A | 1/1959 | Malek |
| 3,001,169 | A | 9/1961 | Blonder |
| 3,091,748 | A | 5/1963 | Takes et al. |
| 3,094,364 | A | 6/1963 | Lingg |
| 3,184,706 | A | 5/1965 | Atkins |
| 3,196,382 | A | 7/1965 | Morello, Jr. |
| 3,245,027 | A | 4/1966 | Ziegler, Jr. |
| 3,275,913 | A | 9/1966 | Blanchard et al. |
| 3,278,890 | A | 10/1966 | Cooney |
| 3,281,757 | A | 10/1966 | Bonhomme |
| 3,292,136 | A | 12/1966 | Somerset |
| 3,320,575 | A | 5/1967 | Brown et al. |
| 3,348,186 | A | 10/1967 | Rosen |

(Continued)

FOREIGN PATENT DOCUMENTS

CA 2096710 A1 11/1994

(Continued)

OTHER PUBLICATIONS

Digicon AVL Connector. ARRIS Group Inc. [online]. 3 pages. [retrieved on Apr. 22, 2010]. Retrieved from the Internet<URL: http://www.arrisi.com/special/digiconAVL.asp>.

(Continued)

*Primary Examiner* — Gary F. Paumen
(74) *Attorney, Agent, or Firm* — Schmeiser, Olsen & Watts

(57) ABSTRACT

A connector comprising a connector body attached to a post, the post including a first end, a second end, and a flange proximate the second end, a port coupling element attached to the post, wherein the port coupling element is rotatable about the post, and a plurality of openings on the post, the plurality of openings extending a distance toward the first end from the flange. Furthermore, a method of maintaining ground continuity in a connector comprising the steps providing a connector body attached to a post, the post having a first end, an opposing second end, and a flange having a plurality of openings positioned thereon, and biasing the flange in a position of interference with a port coupling element, the port coupling element being attached to post is also provided.

21 Claims, 3 Drawing Sheets

U.S. PATENT DOCUMENTS

| | | | |
|---|---|---|---|
| 3,350,677 | A | 10/1967 | Daum |
| 3,355,698 | A | 11/1967 | Keller |
| 3,373,243 | A | 3/1968 | Janowiak et al. |
| 3,390,374 | A | 6/1968 | Forney, Jr. |
| 3,406,373 | A | 10/1968 | Forney, Jr. |
| 3,448,430 | A | 6/1969 | Kelly |
| 3,453,376 | A | 7/1969 | Ziegler, Jr. et al. |
| 3,465,281 | A | 9/1969 | Florer |
| 3,475,545 | A | 10/1969 | Stark et al. |
| 3,498,647 | A | 3/1970 | Schroder |
| 3,517,373 | A | 6/1970 | Jamon |
| 3,533,051 | A | 10/1970 | Ziegler, Jr. |
| 3,537,065 | A | 10/1970 | Winston |
| 3,544,705 | A | 12/1970 | Winston |
| 3,551,882 | A | 12/1970 | O'Keefe |
| 3,564,487 | A | 2/1971 | Upstone et al. |
| 3,587,033 | A | 6/1971 | Brorein et al. |
| 3,601,776 | A | 8/1971 | Curl |
| 3,629,792 | A | 12/1971 | Dorrell |
| 3,633,150 | A | 1/1972 | Swartz |
| 3,663,926 | A | 5/1972 | Brandt |
| 3,665,371 | A | 5/1972 | Cripps |
| 3,668,612 | A | 6/1972 | Nepovim |
| 3,669,472 | A | 6/1972 | Nadsady |
| 3,671,922 | A | 6/1972 | Zerlin et al. |
| 3,678,445 | A | 7/1972 | Brancaleone |
| 3,680,034 | A | 7/1972 | Chow et al. |
| 3,681,739 | A | 8/1972 | Kornick |
| 3,683,320 | A | 8/1972 | Woods et al. |
| 3,686,623 | A | 8/1972 | Nijman |
| 3,694,792 | A | 9/1972 | Wallo |
| 3,710,005 | A | 1/1973 | French |
| 3,739,076 | A | 6/1973 | Schwartz |
| 3,744,007 | A | 7/1973 | Horak |
| 3,778,535 | A | 12/1973 | Forney, Jr. |
| 3,781,762 | A | 12/1973 | Quackenbush |
| 3,781,898 | A | 12/1973 | Holloway |
| 3,793,610 | A | 2/1974 | Brishka |
| 3,798,589 | A | 3/1974 | Deardurff |
| 3,808,580 | A | 4/1974 | Johnson |
| 3,810,076 | A | 5/1974 | Hutter |
| 3,835,443 | A | 9/1974 | Arnold et al. |
| 3,836,700 | A | 9/1974 | Niemeyer |
| 3,845,453 | A | 10/1974 | Hemmer |
| 3,846,738 | A | 11/1974 | Nepovim |
| 3,854,003 | A | 12/1974 | Duret |
| 3,879,102 | A | 4/1975 | Horak |
| 3,886,301 | A | 5/1975 | Cronin et al. |
| 3,907,399 | A | 9/1975 | Spinner |
| 3,910,673 | A | 10/1975 | Stokes |
| 3,915,539 | A | 10/1975 | Collins |
| 3,936,132 | A | 2/1976 | Hutter |
| 3,953,097 | A | 4/1976 | Graham |
| 3,963,320 | A | 6/1976 | Spinner |
| 3,963,321 | A | 6/1976 | Burger et al. |
| 3,970,355 | A | 7/1976 | Pitschi |
| 3,972,013 | A | 7/1976 | Shapiro |
| 3,976,352 | A | 8/1976 | Spinner |
| 3,980,805 | A | 9/1976 | Lipari |
| 3,985,418 | A | 10/1976 | Spinner |
| 4,030,798 | A | 6/1977 | Paoli |
| 4,046,451 | A | 9/1977 | Juds et al. |
| 4,053,200 | A | 10/1977 | Pugner |
| 4,059,330 | A | 11/1977 | Shirey |
| 4,079,343 | A | 3/1978 | Nijman |
| 4,082,404 | A | 4/1978 | Flatt |
| 4,090,028 | A | 5/1978 | Vontobel |
| 4,093,335 | A | 6/1978 | Schwartz et al. |
| 4,106,839 | A | 8/1978 | Cooper |
| 4,125,308 | A | 11/1978 | Schilling |
| 4,126,372 | A | 11/1978 | Hashimoto et al. |
| 4,131,332 | A | 12/1978 | Hogendobler et al. |
| 4,150,250 | A | 4/1979 | Lundeberg |
| 4,153,320 | A | 5/1979 | Townshend |
| 4,156,554 | A | 5/1979 | Aujla |
| 4,165,911 | A | 8/1979 | Laudig |
| 4,168,921 | A | 9/1979 | Blanchard |
| 4,173,385 | A | 11/1979 | Fenn et al. |
| 4,174,875 | A | 11/1979 | Wilson et al. |
| 4,187,481 | A | 2/1980 | Boutros |
| 4,225,162 | A | 9/1980 | Dola |
| 4,227,765 | A | 10/1980 | Neumann et al. |
| 4,229,714 | A | 10/1980 | Yu |
| 4,250,348 | A | 2/1981 | Kitagawa |
| 4,280,749 | A | 7/1981 | Hemmer |
| 4,285,564 | A | 8/1981 | Spinner |
| 4,296,986 | A | 10/1981 | Herrmann et al. |
| 4,307,926 | A | 12/1981 | Smith |
| 4,322,121 | A | 3/1982 | Riches et al. |
| 4,339,166 | A | 7/1982 | Dayton |
| 4,346,958 | A | 8/1982 | Blanchard |
| 4,354,721 | A | 10/1982 | Luzzi |
| 4,358,174 | A | 11/1982 | Dreyer |
| 4,373,767 | A | 2/1983 | Cairns |
| 4,389,081 | A | 6/1983 | Gallusser et al. |
| 4,400,050 | A | 8/1983 | Hayward |
| 4,407,529 | A | 10/1983 | Holman |
| 4,408,821 | A | 10/1983 | Forney, Jr. |
| 4,408,822 | A | 10/1983 | Nikitas |
| 4,421,377 | A | 12/1983 | Spinner |
| 4,426,127 | A | 1/1984 | Kubota |
| 4,444,453 | A | 4/1984 | Kirby et al. |
| 4,452,503 | A | 6/1984 | Forney, Jr. |
| 4,456,323 | A | 6/1984 | Pitcher et al. |
| 4,462,653 | A | 7/1984 | Flederbach et al. |
| 4,464,000 | A | 8/1984 | Werth et al. |
| 4,470,657 | A | 9/1984 | Deacon |
| 4,484,792 | A | 11/1984 | Tengler et al. |
| 4,484,796 | A | 11/1984 | Sato et al. |
| 4,506,943 | A | 3/1985 | Drogo |
| 4,515,427 | A | 5/1985 | Smit |
| 4,525,017 | A | 6/1985 | Schildkraut et al. |
| 4,531,805 | A | 7/1985 | Werth |
| 4,533,191 | A | 8/1985 | Blackwood |
| 4,540,231 | A | 9/1985 | Forney, Jr. |
| RE31,995 | E | 10/1985 | Ball |
| 4,545,637 | A | 10/1985 | Bosshard et al. |
| 4,575,274 | A | 3/1986 | Hayward |
| 4,580,862 | A | 4/1986 | Johnson |
| 4,580,865 | A | 4/1986 | Fryberger |
| 4,583,811 | A | 4/1986 | McMills |
| 4,585,289 | A | 4/1986 | Bocher |
| 4,588,246 | A | 5/1986 | Schildkraut et al. |
| 4,593,964 | A | 6/1986 | Forney, Jr. et al. |
| 4,596,434 | A | 6/1986 | Saba et al. |
| 4,596,435 | A | 6/1986 | Bickford |
| 4,598,961 | A | 7/1986 | Cohen |
| 4,600,263 | A | 7/1986 | DeChamp et al. |
| 4,613,199 | A | 9/1986 | McGeary |
| 4,614,390 | A | 9/1986 | Baker |
| 4,616,900 | A | 10/1986 | Cairns |
| 4,632,487 | A | 12/1986 | Wargula |
| 4,634,213 | A | 1/1987 | Larsson et al. |
| 4,640,572 | A | 2/1987 | Conlon |
| 4,645,281 | A | 2/1987 | Burger |
| 4,650,228 | A | 3/1987 | McMills et al. |
| 4,655,159 | A | 4/1987 | McMills |
| 4,660,921 | A | 4/1987 | Hauver |
| 4,668,043 | A | 5/1987 | Saba et al. |
| 4,674,818 | A | 6/1987 | McMills et al. |
| 4,676,577 | A | 6/1987 | Szegda |
| 4,682,832 | A | 7/1987 | Punako et al. |
| 4,684,201 | A | 8/1987 | Hutter |
| 4,688,876 | A | 8/1987 | Morelli |
| 4,688,878 | A | 8/1987 | Cohen et al. |
| 4,691,976 | A | 9/1987 | Cowen |
| 4,703,987 | A | 11/1987 | Gallusser et al. |
| 4,703,988 | A | 11/1987 | Raux et al. |
| 4,717,355 | A | 1/1988 | Mattis |
| 4,734,050 | A | 3/1988 | Negre et al. |
| 4,734,666 | A | 3/1988 | Ohya et al. |
| 4,737,123 | A | 4/1988 | Paler et al. |
| 4,738,009 | A | 4/1988 | Down et al. |
| 4,746,305 | A | 5/1988 | Nomura |
| 4,747,786 | A | 5/1988 | Hayashi et al. |
| 4,749,821 | A | 6/1988 | Linton et al. |
| 4,755,152 | A | 7/1988 | Elliot et al. |

4,757,297 A 7/1988 Frawley
4,759,729 A 7/1988 Kemppainen et al.
4,761,146 A 8/1988 Sohoel
4,772,222 A 9/1988 Laudig et al.
4,789,355 A 12/1988 Lee
4,806,116 A 2/1989 Ackerman
4,808,128 A 2/1989 Werth
4,813,886 A 3/1989 Roos et al.
4,820,185 A 4/1989 Moulin
4,834,675 A 5/1989 Samchisen
4,835,342 A 5/1989 Guginsky
4,836,801 A 6/1989 Ramirez
4,854,893 A 8/1989 Morris
4,857,014 A 8/1989 Alf et al.
4,867,706 A 9/1989 Tang
4,869,679 A 9/1989 Szegda
4,874,331 A 10/1989 Iverson
4,892,275 A 1/1990 Szegda
4,902,246 A 2/1990 Samchisen
4,906,207 A 3/1990 Banning et al.
4,915,651 A 4/1990 Bout
4,921,447 A 5/1990 Capp et al.
4,923,412 A 5/1990 Morris
4,925,403 A 5/1990 Zorzy
4,927,385 A 5/1990 Cheng
4,929,188 A 5/1990 Lionetto et al.
4,938,718 A 7/1990 Guendel
4,941,846 A 7/1990 Guimond et al.
4,952,174 A 8/1990 Sucht et al.
4,957,456 A 9/1990 Olson et al.
4,973,265 A 11/1990 Heeren
4,979,911 A * 12/1990 Spencer ..... 439/583
4,990,104 A 2/1991 Schieferly
4,990,105 A 2/1991 Karlovich
4,990,106 A 2/1991 Szegda
4,992,061 A 2/1991 Brush, Jr. et al.
5,002,503 A 3/1991 Campbell et al.
5,007,861 A 4/1991 Stirling
5,011,432 A 4/1991 Sucht et al.
5,021,010 A 6/1991 Wright
5,024,606 A 6/1991 Ming-Hwa
5,030,126 A 7/1991 Hanlon
5,037,328 A 8/1991 Karlovich
5,062,804 A 11/1991 Jamet et al.
5,066,248 A 11/1991 Gaver, Jr. et al.
5,073,129 A 12/1991 Szegda
5,080,600 A 1/1992 Baker et al.
5,083,943 A 1/1992 Tarrant
5,120,260 A 6/1992 Jackson
5,127,853 A 7/1992 McMills et al.
5,131,862 A 7/1992 Gershfeld
5,137,470 A 8/1992 Doles
5,137,471 A 8/1992 Verespej et al.
5,141,448 A 8/1992 Mattingly et al.
5,141,451 A 8/1992 Down
5,149,274 A 9/1992 Gallusser et al.
5,154,636 A 10/1992 Vaccaro et al.
5,161,993 A 11/1992 Leibfried, Jr.
5,166,477 A 11/1992 Perin, Jr. et al.
5,181,161 A 1/1993 Hirose et al.
5,186,501 A 2/1993 Mano
5,186,655 A 2/1993 Glenday et al.
5,195,905 A 3/1993 Pesci
5,195,906 A 3/1993 Szegda
5,205,547 A 4/1993 Mattingly
5,205,761 A 4/1993 Nilsson
5,207,602 A 5/1993 McMills et al.
5,215,477 A 6/1993 Weber et al.
5,217,391 A 6/1993 Fisher, Jr.
5,217,393 A 6/1993 Del Negro et al.
5,227,587 A 7/1993 Paterek
5,247,424 A 9/1993 Harris et al.
5,269,701 A 12/1993 Leibfried, Jr.
5,283,853 A 2/1994 Szegda
5,284,449 A 2/1994 Vaccaro
5,294,864 A 3/1994 Do
5,295,864 A 3/1994 Birch et al.
5,316,494 A 5/1994 Flanagan et al.
5,318,459 A 6/1994 Shields
5,334,032 A 8/1994 Myers et al.
5,334,051 A 8/1994 Devine et al.
5,338,225 A 8/1994 Jacobsen et al.
5,342,218 A 8/1994 McMills et al.
5,354,217 A 10/1994 Gabel et al.
5,362,250 A 11/1994 McMills et al.
5,371,819 A 12/1994 Szegda
5,371,821 A 12/1994 Szegda
5,371,827 A 12/1994 Szegda
5,380,211 A 1/1995 Kawagauchi et al.
5,393,244 A 2/1995 Szegda
5,413,504 A 5/1995 Kloecker et al.
5,431,583 A 7/1995 Szegda
5,435,745 A 7/1995 Booth
5,439,386 A 8/1995 Ellis et al.
5,444,810 A 8/1995 Szegda
5,455,548 A 10/1995 Grandchamp et al.
5,456,611 A 10/1995 Henry et al.
5,456,614 A 10/1995 Szegda
5,466,173 A 11/1995 Down
5,470,257 A 11/1995 Szegda
5,474,478 A 12/1995 Ballog
5,490,801 A 2/1996 Fisher, Jr. et al.
5,494,454 A 2/1996 Johnsen
5,499,934 A 3/1996 Jacobsen et al.
5,501,616 A 3/1996 Holliday
5,516,303 A 5/1996 Yohn et al.
5,525,076 A 6/1996 Down
5,542,861 A 8/1996 Anhalt et al.
5,548,088 A 8/1996 Gray et al.
5,550,521 A 8/1996 Bernaud et al.
5,564,938 A 10/1996 Shenkal et al.
5,571,028 A 11/1996 Szegda
5,586,910 A 12/1996 Del Negro et al.
5,595,499 A 1/1997 Zander et al.
5,598,132 A 1/1997 Stabile
5,607,325 A 3/1997 Toma
5,620,339 A 4/1997 Gray et al.
5,632,637 A 5/1997 Diener
5,632,651 A 5/1997 Szegda
5,644,104 A 7/1997 Porter et al.
5,651,698 A 7/1997 Locati et al.
5,651,699 A 7/1997 Holliday
5,653,605 A 8/1997 Woehl et al.
5,667,405 A 9/1997 Holliday
5,683,263 A 11/1997 Hse
5,702,263 A 12/1997 Baumann et al.
5,722,856 A 3/1998 Fuchs et al.
5,746,617 A 5/1998 Porter, Jr. et al.
5,746,619 A 5/1998 Harting et al.
5,769,652 A 6/1998 Wider
5,775,927 A 7/1998 Wider
5,863,220 A 1/1999 Holliday
5,877,452 A 3/1999 McConnell
5,879,191 A 3/1999 Burris
5,882,226 A 3/1999 Bell et al.
5,921,793 A 7/1999 Phillips
5,938,465 A 8/1999 Fox, Sr.
5,944,548 A 8/1999 Saito
5,957,716 A 9/1999 Buckley et al.
5,967,852 A 10/1999 Follingstad et al.
5,975,949 A 11/1999 Holliday et al.
5,975,951 A 11/1999 Burris et al.
5,977,841 A 11/1999 Lee et al.
5,997,350 A 12/1999 Burris et al.
6,010,349 A 1/2000 Porter, Jr.
6,019,635 A 2/2000 Nelson
6,022,237 A 2/2000 Esh
6,032,358 A 3/2000 Wild
6,042,422 A 3/2000 Youtsey
6,048,229 A 4/2000 Lazaro, Jr.
6,053,777 A 4/2000 Boyle
6,089,903 A 7/2000 Stafford Gray et al.
6,089,912 A 7/2000 Tallis et al.
6,089,913 A 7/2000 Holliday
6,123,567 A 9/2000 McCarthy
6,146,197 A 11/2000 Holliday et al.
6,152,753 A 11/2000 Johnson et al.
6,153,830 A 11/2000 Montena

| | | | | |
|---|---|---|---|---|
| 6,210,222 | B1 | 4/2001 | Langham et al. | |
| 6,217,383 | B1 | 4/2001 | Holland et al. | |
| 6,239,359 | B1 | 5/2001 | Lilienthal, II et al. | |
| 6,241,553 | B1 | 6/2001 | Hsia | |
| 6,261,126 | B1 | 7/2001 | Stirling | |
| 6,271,464 | B1 | 8/2001 | Cunningham | |
| 6,331,123 | B1 | 12/2001 | Rodrigues | |
| 6,332,815 | B1 | 12/2001 | Bruce | |
| 6,358,077 | B1 | 3/2002 | Young | |
| D458,904 | S | 6/2002 | Montena | |
| D460,739 | S | 7/2002 | Fox | |
| D460,740 | S | 7/2002 | Montena | |
| D460,946 | S | 7/2002 | Montena | |
| D460,947 | S | 7/2002 | Montena | |
| D460,948 | S | 7/2002 | Montena | |
| 6,422,900 | B1 | 7/2002 | Hogan | |
| 6,425,782 | B1 | 7/2002 | Holland | |
| D461,166 | S | 8/2002 | Montena | |
| D461,167 | S | 8/2002 | Montena | |
| D461,778 | S | 8/2002 | Fox | |
| D462,058 | S | 8/2002 | Montena | |
| D462,060 | S | 8/2002 | Fox | |
| D462,327 | S | 9/2002 | Montena | |
| 6,468,100 | B1 | 10/2002 | Meyer et al. | |
| 6,491,546 | B1 | 12/2002 | Perry | |
| D468,696 | S | 1/2003 | Montena | |
| 6,506,083 | B1 | 1/2003 | Bickford et al. | |
| 6,530,807 | B2 | 3/2003 | Rodrigues et al. | |
| 6,540,531 | B2 | 4/2003 | Syed et al. | |
| 6,558,194 | B2 | 5/2003 | Montena | |
| 6,572,419 | B2 | 6/2003 | Feye-Homann | |
| 6,576,833 | B2 | 6/2003 | Covaro et al. | |
| 6,619,876 | B2 | 9/2003 | Vaitkus et al. | |
| 6,676,446 | B2 | 1/2004 | Montena | |
| 6,683,253 | B1 | 1/2004 | Lee | |
| 6,692,285 | B2 | 2/2004 | Islam | |
| 6,712,631 | B1 | 3/2004 | Youtsey | |
| 6,716,062 | B1 | 4/2004 | Palinkas et al. | |
| 6,733,337 | B2 | 5/2004 | Kodaira | |
| 6,767,248 | B1 | 7/2004 | Hung | |
| 6,786,767 | B1 | 9/2004 | Fuks et al. | |
| 6,790,081 | B2 | 9/2004 | Burris et al. | |
| 6,805,584 | B1 | 10/2004 | Chen | |
| 6,817,896 | B2 | 11/2004 | Derenthal | |
| 6,848,939 | B2 | 2/2005 | Stirling | |
| 6,848,940 | B2 | 2/2005 | Montena | |
| 6,884,115 | B2 | 4/2005 | Malloy | |
| 6,939,169 | B2 | 9/2005 | Islam et al. | |
| 6,971,912 | B2 | 12/2005 | Montena et al. | |
| 7,029,326 | B2 | 4/2006 | Montena | |
| 7,086,897 | B2 | 8/2006 | Montena | |
| 7,097,499 | B1 | 8/2006 | Purdy | |
| 7,114,990 | B2 * | 10/2006 | Bence et al. | 439/583 |
| 7,118,416 | B2 | 10/2006 | Montena et al. | |
| 7,125,283 | B1 | 10/2006 | Lin | |
| 7,147,509 | B1 | 12/2006 | Burris et al. | |
| 7,229,303 | B2 | 6/2007 | Vermoesen et al. | |
| 7,252,546 | B1 | 8/2007 | Holland et al. | |
| 7,255,598 | B2 | 8/2007 | Montena et al. | |
| 7,393,245 | B2 | 7/2008 | Palinkas et al. | |
| 7,476,127 | B1 | 1/2009 | Wei | |
| 7,479,035 | B2 | 1/2009 | Bence et al. | |
| 7,497,729 | B1 | 3/2009 | Wei | |
| 7,507,117 | B2 | 3/2009 | Amidon | |
| 7,566,236 | B2 | 7/2009 | Malloy et al. | |
| 7,607,942 | B1 | 10/2009 | Van Swearingen | |
| 7,674,132 | B1 | 3/2010 | Chen | |
| 7,682,177 | B2 | 3/2010 | Berthet | |
| 7,727,011 | B2 | 6/2010 | Montena et al. | |
| 7,753,705 | B2 | 7/2010 | Montena | |
| 7,794,275 | B2 * | 9/2010 | Rodrigues | 439/584 |
| 7,806,725 | B1 | 10/2010 | Chen | |
| 7,811,133 | B2 | 10/2010 | Gray | |
| 7,824,216 | B2 | 11/2010 | Purdy | |
| 7,828,595 | B2 | 11/2010 | Mathews | |
| 7,833,053 | B2 | 11/2010 | Mathews | |
| 7,845,976 | B2 | 12/2010 | Mathews | |
| 7,845,978 | B1 | 12/2010 | Chen | |
| 7,850,487 | B1 | 12/2010 | Wei | |
| 7,857,661 | B1 | 12/2010 | Islam | |
| 7,892,005 | B2 | 2/2011 | Haube | |
| 7,892,024 | B1 | 2/2011 | Chen | |
| 7,927,135 | B1 | 4/2011 | Wlos | |
| 7,950,958 | B2 | 5/2011 | Mathews | |
| 2002/0013088 | A1 | 1/2002 | Rodrigues et al. | |
| 2002/0038720 | A1 | 4/2002 | Kai et al. | |
| 2003/0214370 | A1 | 11/2003 | Allison et al. | |
| 2004/0077215 | A1 | 4/2004 | Palinkas et al. | |
| 2004/0102089 | A1 | 5/2004 | Chee | |
| 2004/0209516 | A1 | 10/2004 | Burris et al. | |
| 2004/0219833 | A1 | 11/2004 | Burris et al. | |
| 2004/0229504 | A1 | 11/2004 | Liu | |
| 2005/0042919 | A1 | 2/2005 | Montena | |
| 2005/0208827 | A1 | 9/2005 | Burris et al. | |
| 2006/0110977 | A1 | 5/2006 | Matthews | |
| 2006/0154519 | A1 | 7/2006 | Montena | |
| 2007/0026734 | A1 * | 2/2007 | Bence et al. | 439/583 |
| 2008/0102696 | A1 | 5/2008 | Montena | |
| 2009/0029590 | A1 * | 1/2009 | Sykes et al. | 439/585 |
| 2009/0098770 | A1 | 4/2009 | Bence et al. | |
| 2010/0081321 | A1 * | 4/2010 | Malloy et al. | 439/578 |
| 2010/0081322 | A1 | 4/2010 | Malloy et al. | |
| 2010/0255721 | A1 | 10/2010 | Purdy et al. | |
| 2010/0297871 | A1 | 11/2010 | Haube | |
| 2010/0297875 | A1 | 11/2010 | Purdy | |
| 2011/0021072 | A1 | 1/2011 | Purdy | |
| 2011/0053413 | A1 | 3/2011 | Mathews | |
| 2011/0117774 | A1 | 5/2011 | Malloy et al. | |
| 2011/0143567 | A1 | 6/2011 | Purdy et al. | |

FOREIGN PATENT DOCUMENTS

| | | | |
|---|---|---|---|
| CN | 201149936 | Y | 11/2008 |
| CN | 201149937 | Y | 11/2008 |
| CN | 201178228 | Y | 1/2009 |
| DE | 47931 | C | 10/1888 |
| DE | 102289 | C | 4/1899 |
| DE | 1117687 | B | 11/1961 |
| DE | 1191880 | | 4/1965 |
| DE | 1515398 | B1 | 4/1970 |
| DE | 2225764 | A1 | 12/1972 |
| DE | 2221936 | A1 | 11/1973 |
| DE | 2261973 | A1 | 6/1974 |
| DE | 3211008 | A1 | 10/1983 |
| DE | 9001608.4 | U1 | 4/1990 |
| EP | 116157 | A1 | 8/1984 |
| EP | 167738 | A2 | 1/1986 |
| EP | 0072104 | A1 | 2/1986 |
| EP | 0265276 | A2 | 4/1988 |
| EP | 0428424 | A2 | 5/1991 |
| EP | 1191268 | A1 | 3/2002 |
| EP | 1501159 | A1 | 1/2005 |
| EP | 1701410 | A2 | 9/2006 |
| FR | 2232846 | A1 | 1/1975 |
| FR | 2234680 | A2 | 1/1975 |
| FR | 2312918 | | 12/1976 |
| FR | 2462798 | A1 | 2/1981 |
| FR | 2494508 | A1 | 5/1982 |
| GB | 589697 | A | 6/1947 |
| GB | 1087228 | A | 10/1967 |
| GB | 1270846 | A | 4/1972 |
| GB | 1401373 | A | 7/1975 |
| GB | 2019665 | A | 10/1979 |
| GB | 2079549 | A | 1/1982 |
| GB | 2252677 | A | 8/1992 |
| GB | 2264201 | A | 8/1993 |
| GB | 2331634 | A | 5/1999 |
| JP | 3280369 | B2 | 5/2002 |
| KR | 100622526 | B1 | 9/2006 |
| TW | 427044 | B | 3/2001 |
| WO | 8700351 | | 1/1987 |
| WO | 0186756 | A1 | 11/2001 |
| WO | 2004013883 | A2 | 2/2004 |
| WO | 2006081141 | A1 | 8/2006 |

OTHER PUBLICATIONS

U.S. Appl. No. 12/906,559, filed Oct. 18, 2010.

* cited by examiner

CONNECTOR HAVING A CONSTANT CONTACT POST

CROSS-REFERENCE TO RELATED APPLICATIONS

This application is related to U.S. patent application Ser. No. 12/906,559, filed on Oct. 18, 2010 entitled "Connector Having a Constant Contact Nut," the contents of which are incorporated in its entirety.

FIELD OF THE INVENTION

The present invention relates to connectors used in coaxial cable communication applications, and more specifically to embodiments of a coaxial cable connector having a constant contact post that extends electrical continuity through the connector.

BACKGROUND OF THE INVENTION

Broadband communications have become an increasingly prevalent form of electromagnetic information exchange and coaxial cables are common conduits for transmission of broadband communications. Coaxial cables are typically designed so that an electromagnetic field carrying communications signals exists only in the space between inner and outer coaxial conductors of the cables. This allows coaxial cable runs to be installed next to metal objects without the power losses that occur in other transmission lines, and provides protection of the communications signals from external electromagnetic interference. Connectors for coaxial cables are typically connected onto complementary interface ports to electrically integrate coaxial cables to various electronic devices and cable communication equipment. Connection is often made through rotating an internally threaded nut of the connector about a corresponding externally threaded interface port. Fully tightening the threaded connection of the coaxial cable connector to the interface port helps to ensure a ground connection between the connector and the corresponding interface port. However, connectors are often times not properly tightened or otherwise installed. Moreover, the structure of common connectors may permit loss of ground and discontinuity of the electromagnetic shielding that is intended to be extended from the cable, through the connector, and to the corresponding coaxial cable interface port.

Hence, a need exists for an improved connector having a constant contact post for ensuring ground continuity through the connector, and establishing and maintaining electrical and physical communication between the post and a port coupling element.

SUMMARY OF THE INVENTION

A first general aspect of the invention provides a connector comprising a connector body attached to a post, the post including a first end, a second end, and a flange proximate the second end, a port coupling element attached to the post, wherein the port coupling element is rotatable about the post, and a plurality of openings on the post, the plurality of openings extending a distance toward the first end from the flange.

A second general aspect of the invention provides a coaxial cable connector comprising a connector body attached to a post, the post having a first end and an opposing second end, a port coupling element rotatable about the post, wherein the port coupling element has an inner surface, and a plurality of engagement fingers proximate the second end, wherein the plurality of engagement fingers are biased into a position of interference with the inner surface of the port coupling element.

A third general aspect of the invention provides a connector comprising a connector body attached to a post, the post having a first end, an opposing second end, and a slotted flange, the slotted flange being resilient in a radial direction, and a port coupling element attached to the post, wherein a positioning of the port coupling element radially compresses the slotted flange, further wherein the slotted flange exerts an opposing radial contact force against an inner wall of the port coupling element, wherein the opposing radial contact force establishes and maintains physical and electrical contact between the port coupling element and the post regardless of the axial position of the post and the port coupling element.

A fourth general aspect of the invention provides a method of maintaining ground continuity in a connector providing a connector body attached to a post, the post having a first end, an opposing second end, and a flange having a plurality of openings positioned thereon, and biasing the flange in a position of interference with a port coupling element, the port coupling element being attached to post.

A fifth general aspect of the invention provides a method of maintaining electrical continuity with a port comprising providing a connector body attached to a post, the post having a first end and an opposing second end, a port coupling element rotatable about the post, wherein the port coupling element has an internal surface, and a plurality of engagement fingers proximate the second end, the plurality of engagement fingers being resilient in a radial direction, and compressing the plurality of engagement fingers in a radially inward direction, wherein the compression of the plurality of engagement fingers by a positioning of the port coupling element results in the plurality of engagement fingers exerting a radially outward force against the port coupling element, wherein the radially outward force against the port coupling element establishes and maintains physical and electrical continuity between the post and the port coupling element regardless of the relative axial position between the post and the port coupling element.

The foregoing and other features of construction and operation of the invention will be more readily understood and fully appreciated from the following detailed disclosure, taken in conjunction with accompanying drawings.

BRIEF DESCRIPTION OF THE DRAWINGS

Some of the embodiments of this invention will be described in detail, with reference to the following figures, wherein like designations denote like members, wherein.

DETAILED DESCRIPTION

Although certain embodiments of the present invention are shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of embodiments of the present invention.

As a preface to the detailed description, it should be noted that, as used in this specification and the appended claims, the singular forms "a", "an" and "the" include plural referents, unless the context clearly dictates otherwise.

Figure 1:
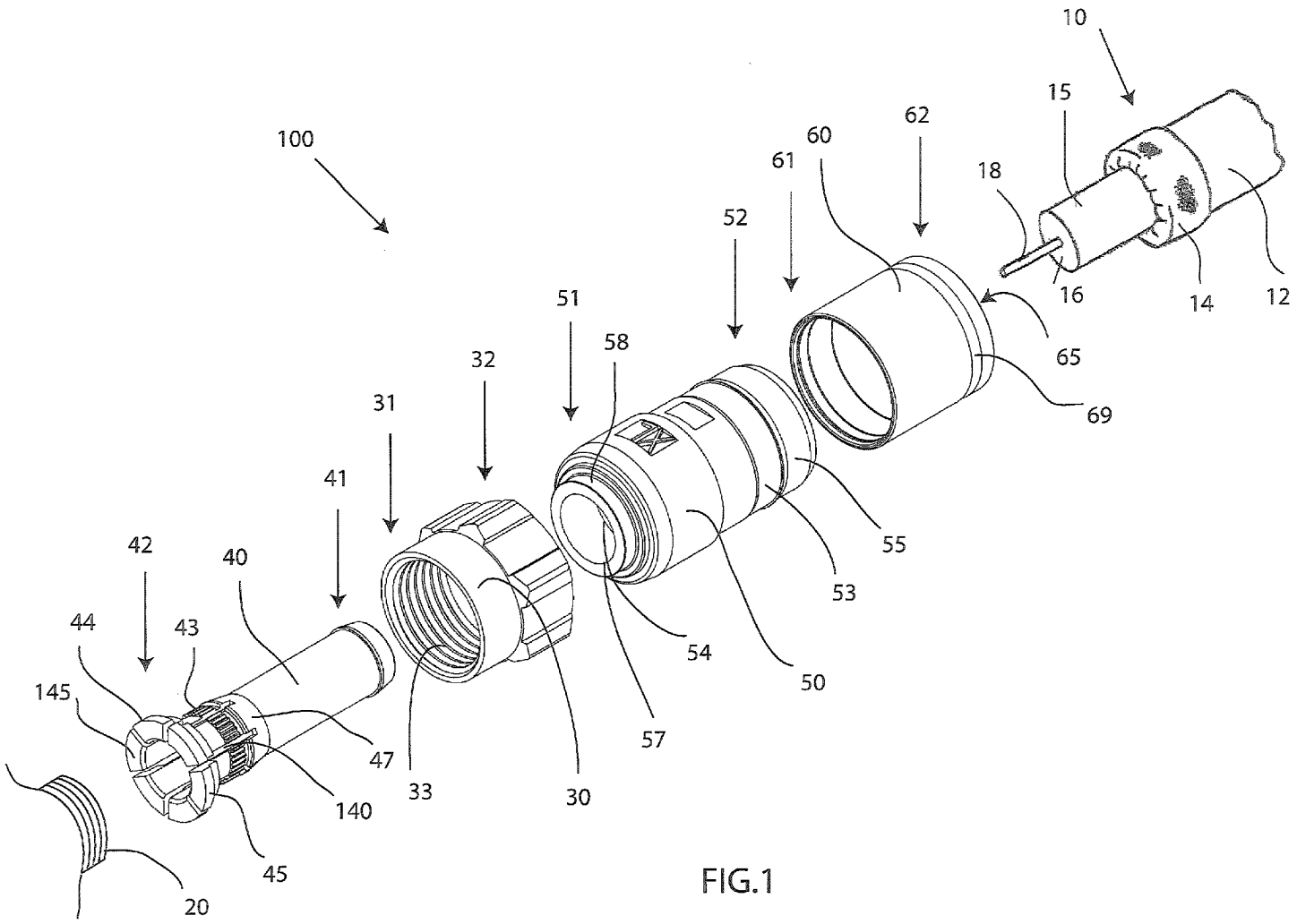
FIG. 1 depicts an exploded perspective cut-away view of an embodiment of the elements of an embodiment of a coaxial cable connector, in accordance with the present invention.

Referring to the drawings, FIG. 1 depicts one embodiment of a coaxial cable connector. The coaxial cable connector 100 may accept a prepared coaxial cable 10, and may be operably affixed to a coaxial cable 10 so that the cable 10 is securely attached to the connector 100. The coaxial cable 10 may include a protective outer jacket 12, a conductive grounding shield 14, a dielectric foil layer 15, an interior dielectric 16 and a center conductor 18. The coaxial cable 10 may be prepared as embodied in FIG. 1 by removing the protective outer jacket 12 and drawing back the conductive grounding shield 14 to expose a portion of the dielectric foil layer 15 surrounding the interior dielectric 16. Further preparation of the embodied coaxial cable 10 may include stripping the dielectric foil layer 15 and the dielectric 16 to expose a portion of the center conductor 18. The protective outer jacket 12 is intended to protect the various components of the coaxial cable 10 from damage which may result from exposure to dirt or moisture and from corrosion. Moreover, the protective outer jacket 12 may serve in some measure to secure the various components of the coaxial cable 10 in a contained cable design that protects the cable 10 from damage related to movement during cable installation. The conductive grounding shield 14 can be comprised of conductive materials suitable for providing an electrical ground connection.

Various embodiments of the shield 14 may be employed to screen unwanted noise. For instance, the shield 14 may comprise a metal foil wrapped around the dielectric 16, or several conductive strands formed in a continuous braid around the dielectric 16. Combinations of foil and/or braided strands may be utilized wherein the conductive shield 14 may comprise a foil layer, then a braided layer, and then a foil layer. Those in the art will appreciate that various layer combinations may be implemented in order for the conductive grounding shield 14 to effectuate an electromagnetic buffer helping to prevent ingress of environmental noise that may disrupt broadband communications. The dielectric 16 can be comprised of materials suitable for electrical insulation. It should be noted that the various materials of which all the various components of the coaxial cable 10 are comprised should have some degree of elasticity allowing the cable 10 to flex or bend in accordance with traditional broadband communications standards, installation methods and/or equipment. It should further be recognized that the radial thickness of the coaxial cable 10, protective outer jacket 12, conductive grounding shield 14, dielectric foil layer 15, interior dielectric 16 and/or center conductor 18 may vary based upon generally recognized parameters corresponding to broadband communication standards and/or equipment.

Referring further to FIG. 1, the connector 100 is configured to attach to a coaxial cable interface port, such as, for example, interface port 20. The coaxial cable interface port 20 includes a conductive receptacle for receiving a portion of a coaxial cable center conductor 18 sufficient to make adequate electrical contact. The coaxial cable interface port 20 may further comprise a threaded exterior surface 23. It should be recognized that the radial thickness and/or the length of the coaxial cable interface port 20 and/or the conductive receptacle of the port 20 may vary based upon generally recognized parameters corresponding to broadband communication standards and/or equipment. Moreover, the pitch and height of threads which may be formed upon the threaded exterior surface 23 of the coaxial cable interface port 20 may also vary based upon generally recognized parameters corresponding to broadband communication standards and/or equipment. Furthermore, it should be noted that the interface port 20 may be formed of a single conductive material, multiple conductive materials, or may be configured with both conductive and non-conductive materials corresponding to the port's 20 operable electrical interface with a connector 100. However, the receptacle 22 of the interface port 20 should be formed of a conductive material. Further still, it will be understood by those of ordinary skill that the interface port 20 may be embodied by a connective interface component of a coaxial cable communications device, a television, a modem, a computer port, a network receiver, or other communications modifying devices such as a signal splitter, a cable line extender, a cable network module and/or the like.

With continued reference to FIG. 1, an embodiment of a coaxial cable connector 100 may comprise a port coupling element 30, a post 40 having a flange 44, a connector body 50, and a fastener member 60. In another embodiment, connector 100 may comprise a connector body 50 attached to a post 40, the post 40 including a first end 41, a second end 42, and a flange 44 proximate the second end 42, a port coupling element 30 attached to the post 40, wherein the port coupling element 30 is rotatable about the post 40, and a plurality of openings 140 on the post 40, the plurality of openings 140 extending a distance toward the first end 41 from the flange 44. In an alternative embodiment, connector 100 may comprise a connector body 50 attached to a post 40, the post 40 having a first end 41 and an opposing second end 42, a port coupling element 30 rotatable about the post, wherein the port coupling element 30 has an inner surface 35, and a plurality of engagement fingers 145 proximate the second end 42, wherein the plurality of engagement fingers 145 are biased into a position of interference with the inner surface 35 of the port coupling element 30. In another exemplary embodiment, the connector 100 may comprise a connector body 50 attached to a post 40, the post 40 having a first end 41, an opposing second end 42, and a slotted flange 44, the slotted flange 44 being resilient in a radial direction, and a port coupling element 30 attached to the post 40, wherein a positioning of the port coupling element 30 radially compresses the slotted flange 44, further wherein the slotted flange 44 exerts an opposing radial contact force against an inner wall 35 of the port coupling element 30, wherein the opposing radial contact force establishes and maintains physical and electrical contact between the port coupling element 30 and the post 40 regardless of the axial position of the post 40 and the port coupling element 30.

Furthermore, the port coupling element 30, or threaded nut 30, of embodiments of a coaxial cable connector 100 has a first end 31 and opposing second end 32. The threaded nut 30 may be rotatably secured to the post 40 to allow for rotational movement about the post. For example, the threaded nut 30 may freely rotate, or spin, about the stationary post 40. The threaded nut 30 may comprise an internal lip 34 located proximate, or otherwise near to the second end 32 and configured to hinder axial movement of the post 40. The threaded nut 30 may also comprise internal threading 33 extending axially from the edge of first end 31 a distance sufficient to provide operably effective threadable contact with the external threads 23 of a standard coaxial cable interface port 20. The structural configuration of the nut 30 may vary according to accommodate different functionality of a coaxial cable connector 100. For instance, the first end 31 of the nut 30 may include internal and/or external structures such as ridges grooves, curves, detents, slots, openings, chamfers, or other structural features, etc., which may facilitate the operable joining of an environmental sealing member, such as an water-tight seal, that may help prevent ingress of environmental contaminants at the first end 31 of a nut 30, when mated with an interface port 20. Moreover, the second end 32, of the nut 30 may extend a significant axial distance to reside radially extent of the connector body 50, although the extended portion of the nut 30 need not contact the connector body 50. The nut 30, or port coupling element, includes a generally axial opening, as shown in FIG. 1, and has an inner surface 35 which may include internal threading 33. The inner surface 35 of nut 30 may also be an inner wall, inside surface, and the like. In another embodiment of the inner surface 35, the inside diameter of the nut 30 at any point along the surface may be considered the inner surface 35 of the nut. In many embodiments of connector 100, the post 40 contacts the inner surface 35 of the nut 30 proximate the internal lip 34.

The threaded nut 30 may be formed of conductive materials facilitating grounding through the nut 30. Accordingly the nut 30 may be configured to extend an electromagnetic buffer by electrically contacting conductive surfaces of an interface port 20 when a connector 100 is advanced onto the port 20. In addition, the threaded nut 30 may be formed of both conductive and non-conductive materials. For example the external surface of the nut 30 may be formed of a polymer, while the remainder of the nut 30 may be comprised of a metal or other conductive material. The threaded nut 30 may be formed of metals or polymers or other materials that would facilitate a rigidly formed nut body. Manufacture of the threaded nut 30 may include casting, extruding, cutting, knurling, turning, tapping, drilling, injection molding, blow molding, or other fabrication methods that may provide efficient production of the component. Those in the art should appreciate the various embodiments of the nut 30 may also comprise a coupler member having no threads, but being dimensioned for operable connection to a corresponding to an interface port, such as interface port 20.

Referring still to FIG. 1, an embodiment of a connector 100 may include a post 40. The post 40 comprises a first end 41 and opposing second end 42. Furthermore, the post 40 comprises a flange 44, such as an externally extending annular protrusion, located at the second end 42 of the post 40. The flange 44 may include a tapered surface facing the first end 41 of the post 40. Further still, an embodiment of the post 40 may include a surface feature 47 such as a lip or protrusion that may engage a portion of a connector body 50 to secure axial movement of the post 40 relative to the connector body 50. However, the post may not include such a surface feature 47, and the coaxial cable connector 100 may rely on press-fitting and friction-fitting forces and/or other component structures to help retain the post 40 in secure location both axially and rotationally relative to the connector body 50. The location proximate or otherwise near where the connector body is secured relative to the post 40 may include surface features 43, such as ridges, grooves, protrusions, or knurling, which may enhance the secure location of the post 40 with respect to the connector body 50. Additionally, the post 40 includes a mating edge 46, which may be configured to make physical and electrical contact with a corresponding mating edge of an interface port 20. The post 40 should be formed such that portions of a prepared coaxial cable 10 including the dielectric foil layer 15, the dielectric 16 and center conductor 18 can pass axially into the second end 42 and/or through a portion of the tube-like body of the post 40. Moreover, the post 40 should be dimensioned such that the post 40 may be inserted into an end of the prepared coaxial cable 10, around the dielectric foil layer 15 surrounding the dielectric 16 and under the protective outer jacket 12 and conductive grounding shield 14. Accordingly, where an embodiment of the post 40 may be inserted into an end of the prepared coaxial cable 10 under the drawn back conductive grounding shield 14, substantial physical and/or electrical contact with the shield 14 may be accomplished thereby facilitating grounding through the post 40. The post 40 may be formed of metals or other conductive materials that would facilitate a rigidly formed post body. In addition, the post 40 may be formed of a combination of both conductive and non-conductive materials. For example, a metal coating or layer may be applied to a polymer of other non-conductive material. Manufacture of the post 40 may include casting, extruding, cutting, turning, drilling, knurling, injection molding, spraying, blow molding, component overmolding, or other fabrication methods that may provide efficient production of the component.

Figure 3:
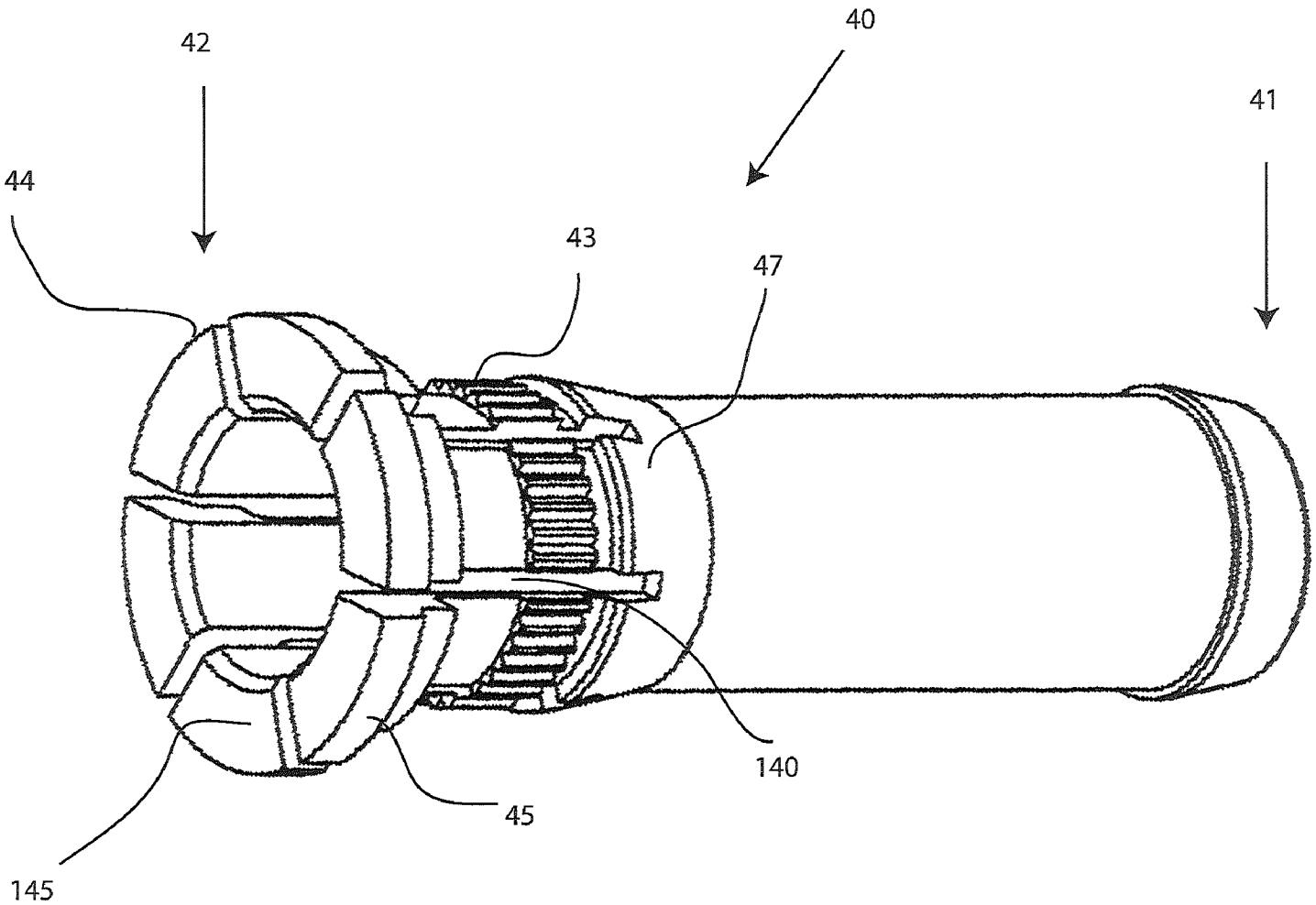
FIG. 3 depicts a perspective view of an embodiment of a post.

With continued reference to FIG. 1, and additional reference to FIG. 3, post 40 includes a plurality of slots 140 positioned somewhere on or around the post 40 proximate or otherwise near the second end 42. A plurality of slots 140 may be a plurality of openings, spaces, voids, apertures, holes, cuts, channels, grooves, and the like, positioned on the flange 44 and a portion of the post 40 proximate or otherwise near the second end 42 of the post 40. For instance, the slots 140 can be axially aligned with the post 40; moreover, the slots 140 can axially extend through the flange 44 a distance from the second end 42 towards the first end 41. In one embodiment, the slots 140 extend from the second end 42 to proximate or otherwise near the surface feature 47. In other embodiments, the slots 140 may extend to proximate or otherwise near a third of the length of the post 40. In many embodiments, the distance the slots axially extend through the flange 44 may vary, depending on the amount of deflection sought when compressed and/or the amount of any reactive radially outward force needed to establish and maintain physical and electrical continuity with the port coupling element 30. A post 40 having slots 140 axially extending too far along the post 40 toward the first end 41 may risk a partial or significant loss in the structural integrity of the post 40, and may not achieve the suitable amount of radial force to bias it into a position of interference with the port coupling element 30. Those skilled in the art should appreciate that the slots 130 can be used to make the nut 30 resilient in the radial direction; therefore, slots 130 may vary in size, shape, appearance, and the like. The nut 30 may be made resilient without introducing voids between portions of the nut 30. For example, instead of voids, such as slots 140, the post 40 may have portions separated by webbing, spacers, meshing, flexible material, netting, and the like.

Furthermore, the width of the slots 140 may vary based upon generally recognized parameters corresponding to broadband communication standards and/or equipment. A decrease in the width of the slots 140 can lead to increase in surface area of the outer edges 45 of the flange 44, and vice versa. The outer edges 45 of the flange 44 can make physical contact with an inner surface 35 of the port coupling element 30; therefore, the width of the slots 140 should be balanced with the amount of desired surface area of the outer edges 45 of the flange 44. One having ordinary skill in the art should also consider the structural properties of the materials used to manufacture the post 40, the flange 44, and other connector 100 components, such as the modulus of elasticity of the material, ductility, yield strength, and the like, to determine the dimensions (i.e. length, width, depth) and the number of slots 140 positioned on the post 40. Ostensibly, the slots 140 have a depth equal to the thickness of the post 40 (i.e. from the inner surface of the post 40 to outer surface of the post 40). In other words, the slots 140 can be spaces where portions of the flange 44 and the post 40 have been removed, extruded, cut, extracted, etc. Moreover, the number of slots 140 and the axial length of the slots 140 should be optimized to provide the best balance of reliable interference, or contact, with the nut 30. Other factors to consider may be achieving reduced drag, and keeping down any costs associated with the manufacture, production, and operation of the connector 100.

In an alternative embodiment, the post 40 may include two slots 140, positioned relatively near each other, creating a single flexible finger. The reduction of slots 140 to include only two, generally narrow slots would increase the overall strength of the component. However, the single flexible finger created by the two slots 140 may still be resilient such that it radially expands inward due to interference with a nut 30, constantly exerting a radially outward force against the nut 30. Those skilled in the art should appreciate that the same effect may be achieved with more than two slots 140, keeping to an overall low number of total slots 140.

Referring still to FIG. 1, slotting the post flange 44 makes it resilient in the radial direction. For example, the flange 44 may flex, deflect, move, bend, etc., in a radially outward direction and a radially inward direction. The slots 140 allow the flange 44 to radially compress (i.e. radially inward direction) from an initial position when subjected to an external force, such as the inner surface 35 of the nut 30 (while operably configured). One example of an initial position of the flange 44 may be a slightly expanded position, wherein the attachment of the nut 30 to the post 40 may require or result in a slight compression of the flange 44. Because the post flange 44 having a plurality of slots 140 is resilient, flexible, capable of deflection, etc. in the radial directions (e.g. radially inward and outward), the flange 44 may be biased into a position of interference with the nut 30. For instance, the operable attachment of the nut 30 to the post 40 may slightly compress the flange 44 from an expanded, initial position, or rest position, in a radially inward direction via the contact being made between the outer edge 45 of the flange 44 and the inner surface 35 of the nut 30. Accordingly, the resilient flange 44 may flex back, or "spring" back, exerting a constant outward radial force (i.e. a biasing force, reactive force, etc.) against the inner surface 35 of the nut 30 to return to its initial position of rest, prior to the slight compression. The constant outward radial force exerted by the flange 44 against the inner surface 35 of the port coupling element 30 establishes and maintains electrical continuity between the post 40 and port coupling element 30, regardless of their axial position. The deflection, or movement, of the flange 44 in a radially inward direction based on any compression from the port coupling element 30 need not be significant or readily apparent; a slight deflection of the flange 44 in a radially inward direction is sufficient to prompt a constant radially outward force due to the biasing relationship between the flange 44 and the inner surface 35 of the port coupling element 30.

Figure 2:
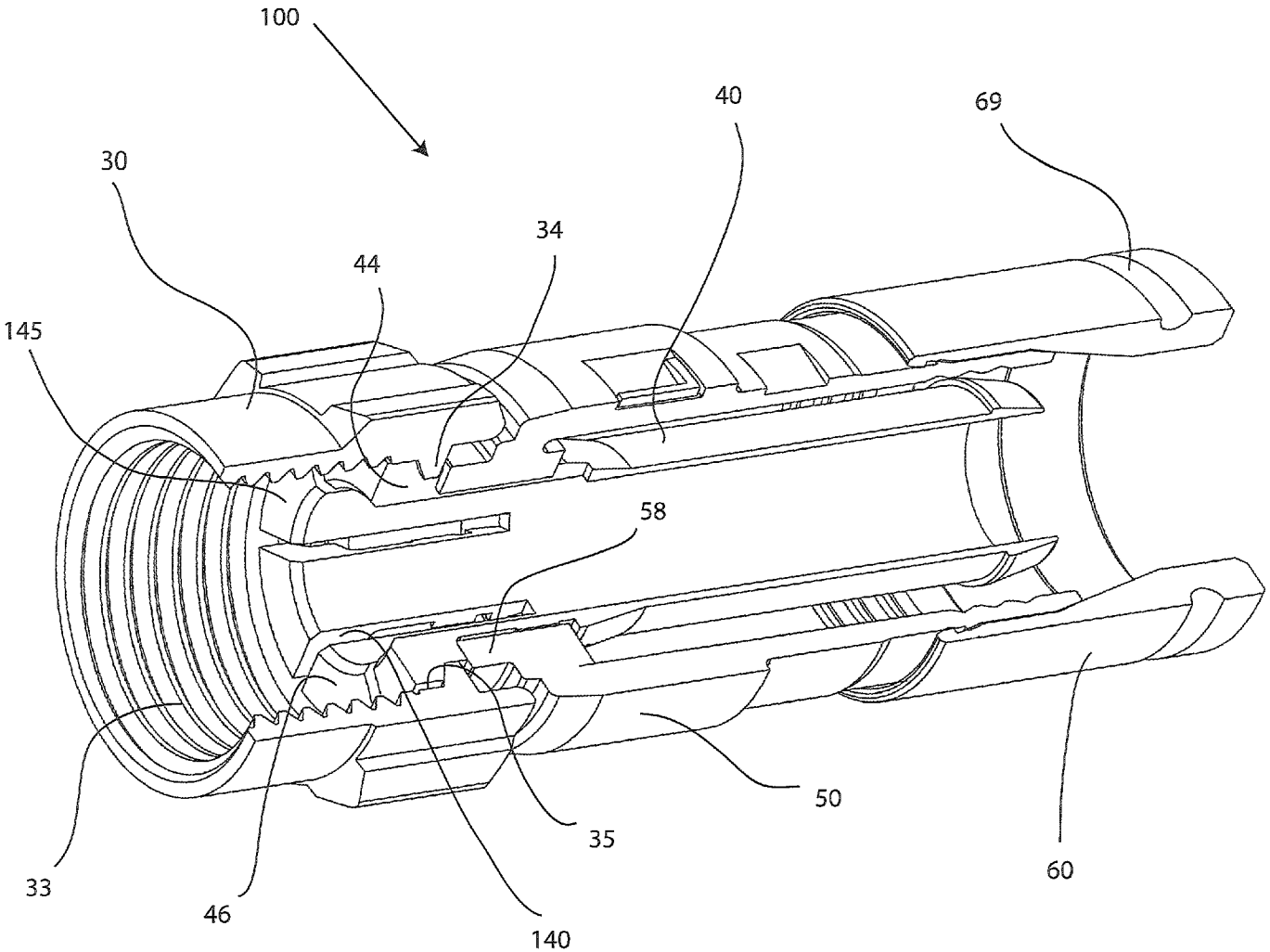
FIG. 2 depicts a perspective cut-away view of an embodiment of a connector.

In one embodiment of connector 100, the outer diameter of the flange 44 may be slightly larger than the inner diameter of the nut 30 proximate or otherwise near the second end 32, which may require, or result in, a slight compression of the flange 44 when the nut 30 is attached to the post 40. While operably configured, the constant biasing force of the outer edges 45 of the flange 44 against the inner surface 35 of the nut 30 can establish and maintain physical and electrical contact between the post 40 and the nut 30, as depicted in FIG. 2. The constant biasing force against the surface of the nut 30 helps establish and maintain physical and electrical continuity between the post 40 and the nut 30 in installation situations where it may be undesirable to fully tighten the connector 100 to a port, similar to interface port 20, for example, a consumer device where there may be a concern of the port 20 fracturing or breaking. Additionally, the constant biasing force of the slotted flange 44 helps establish and maintain physical and electrical continuity in situations where a connector 100 is unintentionally not fully tightened to a port 20. Those skilled in the art should appreciate that physical and electrical continuity between the post 40 and the port coupling element 30 is desirable in situations involving connector 100 other than those described herein.

With reference to FIG. 3, and continued reference to FIG. 1, another embodiment of connector 100 includes a post 40 having a first end 41, a second end 42, and a plurality of engagement fingers 145 proximate or otherwise near the second end 42. Engagement fingers 145 can be portions of the post 40 proximate or otherwise near the second end 42 that are separated, or spaced apart, by slots 140 running axially through the flange 44 and a portion of the post 40 proximate or otherwise near the second end 42. Engagement fingers 145 may also be resilient members, biasing members, fingers, biasing fingers, post fingers, teeth, engagement teeth, post teeth, expanding members, flexible members, and the like. The number of engagement fingers 145 depends on the number of slots 140 positioned on the post 40. For example, if the post 40 has six slots 140 axially extending from the second end 42, six engagement fingers 145 would be formed. Moreover, the engagement fingers 145 spaced apart by slots 140, or openings, are resilient in the radial directions (e.g. radially inward and outward). In one non-limiting example, as the nut 30 is operably attached to the post 40, the engagement fingers 145 may slightly compress radially inward to accommodate the attachment of the nut 30. When the nut 30 is attached to the post 40 (i.e. while operably configured), the resilient engagement fingers 145 should flex, expand, or "spring" back in a radially outward direction, applying a constant radial contact force with the nut 30, in particular, the inner surface 35 of the nut 30. The constant radial contact force applied by the engagement fingers 145 against the inside surface of the nut 30 may establish and maintain physical and electrical continuity between the post 40 and the nut 30. In many embodiments, the outer edges 45 of the engagement fingers 145 contact the inner surface 35 of the nut 30. In another embodiment, the engagement fingers 145 are in a biasing relationship with the port coupling element.

Referring again to FIG. 1, embodiments of a coaxial cable connector, such as connector 100, may include a connector body 50. The connector body 50 may comprise a first end 51 and opposing second end 52. Moreover, the connector body may include a post mounting portion 57 proximate or otherwise near the first end 51 of the body 50, the post mounting portion 57 configured to securely locate the body 50 relative to a portion of the outer surface of post 40, so that the connector body 50 is axially secured with respect to the post 40, in a manner that prevents the two components from moving with respect to each other in a direction parallel to the axis of the connector 100. In addition, the connector body 50 may include an outer annular recess 58 located proximate or near the first end 51 of the connector body 50. Furthermore, the connector body 50 may include a semi-rigid, yet compliant outer surface 55, wherein the outer surface 55 may be configured to form an annular seal when the second end 52 is deformably compressed against a received coaxial cable 10 by operation of a fastener member 60. The connector body 50 may include an external annular detent 53 located proximate or close to the second end 52 of the connector body 50. Further still, the connector body 50 may include internal surface features, such as annular serrations formed near or proximate the internal surface of the second end 52 of the connector body 50 and configured to enhance frictional restraint and gripping of an inserted and received coaxial cable 10, through tooth-like interaction with the cable. The connector body 50 may be formed of materials such as plastics, polymers, bendable metals or composite materials that facilitate a semi-rigid, yet compliant outer surface 55. Further, the connector body 50 may be formed of conductive or non-conductive materials or a combination thereof. Manufacture of the connector body 50 may include casting, extruding, cutting, turning, drilling, knurling, injection molding, spraying, blow molding, component overmolding, combinations thereof, or other fabrication methods that may provide efficient production of the component.

With further reference to FIG. 1, embodiments of a coaxial cable connector 100 may include a fastener member 60. The fastener member 60 may have a first end 61 and opposing second end 62. In addition, the fastener member 60 may include an internal annular protrusion located proximate the first end 61 of the fastener member 60 and configured to mate and achieve purchase with the annular detent 53 on the outer surface 55 of connector body 50. Moreover, the fastener member 60 may comprise a central passageway 65 defined between the first end 61 and second end 62 and extending axially through the fastener member 60. The central passageway 65 may comprise a ramped surface which may be positioned between a first opening or inner bore having a first diameter positioned proximate with the first end 61 of the fastener member 60 and a second opening or inner bore having a second diameter positioned proximate with the second end 62 of the fastener member 60. The ramped surface may act to deformably compress the outer surface 55 of a connector body 50 when the fastener member 60 is operated to secure a coaxial cable 10. For example, the narrowing geometry will compress squeeze against the cable, when the fastener member is compressed into a tight and secured position on the connector body. Additionally, the fastener member 60 may comprise an exterior surface feature 69 positioned proximate with or close to the second end 62 of the fastener member 60. The surface feature 69 may facilitate gripping of the fastener member 60 during operation of the connector 100. Although the surface feature 69 is shown as an annular detent, it may have various shapes and sizes such as a ridge, notch, protrusion, knurling, or other friction or gripping type arrangements. The first end 61 of the fastener member 60 may extend an axial distance so that, when the fastener member 60 is compressed into sealing position on the coaxial cable 100, the fastener member 60 touches or resides substantially proximate significantly close to the nut 30. It should be recognized, by those skilled in the requisite art, that the fastener member 60 may be formed of rigid materials such as metals, hard plastics, polymers, composites and the like, and/or combinations thereof. Furthermore, the fastener member 60 may be manufactured via casting, extruding, cutting, turning, drilling, knurling, injection molding, spraying, blow molding, component overmolding, combinations thereof, or other fabrication methods that may provide efficient production of the component.

The manner in which the coaxial cable connector 100 may be fastened to a received coaxial cable 10 may also be similar to the way a cable is fastened to a connector having an insertable compression sleeve that is pushed into the connector body 50 to squeeze against and secure the cable 10. The coaxial cable connector 100 includes an outer connector body 50 having a first end 51 and a second end 52. The body 50 at least partially surrounds a tubular inner post 40. The tubular inner post 40 has a first end 41 including a slotted flange 44 and a second end 42 configured to mate with a coaxial cable 10 and contact a portion of the outer conductive grounding shield or sheath 14 of the cable 10. The connector body 50 is secured relative to a portion of the tubular post 40 proximate or close to the first end 41 of the tubular post 40 and cooperates, or otherwise is functionally located in a radially spaced relationship with the inner post 40 to define an annular chamber with a rear opening. A tubular locking compression member may protrude axially into the annular chamber through its rear opening. The tubular locking compression member may be slidably coupled or otherwise movably affixed to the connector body 50 to compress into the connector body and retain the cable 10 and may be displaceable or movable axially or in the general direction of the axis of the connector 100 between a first open position (accommodating insertion of the tubular inner post 40 into a prepared cable 10 end to contact the grounding shield 14), and a second clamped position compressibly fixing the cable 10 within the chamber of the connector 100, because the compression sleeve is squeezed into retraining contact with the cable 10 within the connector body 50. A port coupling element, or nut 30, at the front end of the inner post 40 serves to attach the connector 100 to an interface port.

Referring now to FIGS. 1-3, a first embodiment of a method for maintaining ground continuity between the free-spinning nut 30 and the stationary post 40 of a connector 100 may comprise the steps of providing a connector body 50 attached to a post 40, the post having a first end 41, an opposing second end 42, and a flange 44 having a plurality of openings 140 positioned thereon, and biasing the flange 44 in a position of interference with a port coupling element 30, the port coupling element 30 being attached to post 40. The method may also include an outer edge 45 of the flange 44 exerting a constant radial contact force against the inner surface 35 of the port coupling element 30, and a fastener member 60, wherein the fastener member 60 is configured to operate on and deform the connector body 50 sealingly compressing it against and affixing it to a coaxial cable 10. The method may include steps with reference to the multiple embodiments described herein.

A second embodiment of a method of maintaining electrical continuity with a port may comprise the steps of providing a connector body 50 attached to a post 40, the post 40 having a first end 41 and an opposing second end 42, a port coupling element 30 rotatable about the post 40, wherein the port coupling element 30 has an internal surface 35, and a plurality of engagement fingers 145 proximate the second end 42, the plurality of engagement fingers 145 being resilient in a radial direction, and compressing the plurality of engagement fingers 145 in a radially inward direction, wherein the compression of the plurality of engagement fingers 145 by a positioning of the port coupling element 30 results in the plurality of engagement fingers 145 exerting a radially outward force against the port coupling element 30, wherein the radially outward force against the port coupling element 30 establishes and maintains physical and electrical continuity between the post 40 and the port coupling element 30 regardless of the relative axial position between the post 40 and the port coupling element 30. The method may also include the outer edge 45 of each of the plurality of engagement fingers 145 constantly contacting the internal surface 35 of the port coupling element 30 when the plurality of engagement fingers 145 exert the radially outward force against the port coupling element 30, a fastener member 60, wherein the fastener member 60 is configured to operate on and deform the connector body 50 sealingly compressing it against and affixing it to a coaxial cable 10, and spacing the plurality of engagement fingers 145 apart by axially aligned slots 140 positioned on the post 40 proximate the second end 42.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

What is claimed is:

1. A coaxial cable connector comprising:

a connector body attached to a post, the post including a first end, a second end, and a flange proximate the second end;

a port coupling element attached to the post, wherein the port coupling element is rotatable about the post; and a plurality of openings on the post, the plurality of openings extending a distance toward the first end from the flange.

2. The connector of claim 1, wherein an outer edge of the flange exerts a constant radial force against an inner surface of the port coupling element to establish and maintain physical and electrical continuity between the post and the port coupling element.

3. The connector of claim 1, wherein the plurality of openings are axially extending slots across the flange and a portion of the post which allow radial movement of the flange.

4. The connector of claim 1, further comprising:

a fastener member, wherein the fastener member is configured to operate on and deform the connector body sealingly compressing it against and affixing it to a coaxial cable.

5. A coaxial cable connector comprising:

a connector body attached to a post, the post having a first end and an opposing second end;

a port coupling element rotatable about the post, wherein the port coupling element has an inner surface; and a plurality of engagement fingers proximate the second end, wherein the plurality of engagement fingers are biased into a position of interference with the inner surface of the port coupling element.

6. The connector of claim 5, wherein an outer edge of each of the plurality of engagement fingers exerts a constant radial force against an inner surface of the port coupling element to establish and maintain physical and electrical continuity between the post and the port coupling element.

7. The connector of claim 5, further comprising:

a fastener member, wherein the fastener member is configured to operate on and deform the connector body sealingly compressing it against and affixing it to a coaxial cable.

8. The connector of claim 5, wherein the plurality of engagement fingers are spaced apart by axially aligned slots positioned on the post proximate the second end.

9. A coaxial cable connector comprising:

a connector body attached to a post, the post having a first end, an opposing second end, and a slotted flange, the slotted flange being resilient in a radial direction; and a port coupling element attached to the post, wherein a positioning of the port coupling element radially compresses the slotted flange, further wherein the slotted flange exerts an opposing radial contact force against an inner wall of the port coupling element;

wherein the opposing radial contact force establishes and maintains physical and electrical contact between the port coupling element and the post regardless of the axial position of the post and the port coupling element.

10. The connector of claim 9, wherein the slotted flange includes a plurality of axially aligned openings that space apart portions of the flange and the post.

11. The connector of claim 9, further comprising:

a fastener member, wherein the fastener member is configured to operate on and deform the connector body sealingly compressing it against and affixing it to a coaxial cable.

12. The connector of claim 9, wherein the opposing radial contact force is constant.

13. A method for maintaining ground continuity in a connector comprising:

providing a connector body attached to a post, the post having a first end, an opposing second end, and a flange having a plurality of openings positioned thereon; and biasing the flange in a position of interference with a port coupling element, the port coupling element being attached to post.

14. The method of claim 13, wherein an outer edge of the flange exerts a constant radial contact force against the inner surface of the port coupling element.

15. The method of claim 13, further comprising:

a fastener member, wherein the fastener member is configured to operate on and deform the connector body sealingly compressing it against and affixing it to a coaxial cable.

16. The method of claim 13, wherein the flange is resilient.

17. The method of claim 13, wherein the plurality of openings are axially aligned slots, that space apart portions of the flange and the post.

18. A method for maintaining electrical continuity with a port comprising:

providing a connector body attached to a post, the post having a first end and an opposing second end, a port coupling element rotatable about the post, wherein the port coupling element has an internal surface, and a plurality of engagement fingers proximate the second end, the plurality of engagement fingers being resilient in a radial direction; and compressing the plurality of engagement fingers in a radially inward direction, wherein the compression of the plurality of engagement fingers by a positioning of the port coupling element results in the plurality of engagement fingers exerting a radially outward force against the port coupling element;

wherein the radially outward force against the port coupling element establishes and maintains physical and electrical continuity between the post and the port coupling element regardless of the relative axial position between the post and the port coupling element.

19. The method of claim 18, wherein the outer edge of each of the plurality of engagement fingers constantly contact the internal surface of the port coupling element when the plurality of engagement fingers exert the radially outward force against the port coupling element.

20. The method of claim 18, further comprising:

a fastener member, wherein the fastener member is configured to operate on and deform the connector body sealingly compressing it against and affixing it to a coaxial cable.

21. The method of claim 18, wherein the plurality of engagement fingers are spaced apart by axially aligned slots positioned on the post proximate the second end.

* * * * *